US005143754A

United States Patent [19]

Long et al.

[11] Patent Number: 5,143,754

[45] Date of Patent: Sep. 1, 1992

[54] SOLVENT FUSING OF THERMAL PRINTER DYE IMAGE

[75] Inventors: Michael E. Long, Penfield; David L. VanGalio, Brockport; Helmut Weber, Webster, all of N.Y.

[73] Assignee: Eastman Kodak Company, Rochester, N.Y.

[21] Appl. No.: 739,070

[22] Filed: Aug. 1, 1991

[51] Int. Cl.[5] ..... B05D 3/04

[52] U.S. Cl. ..... 427/335; 427/350; 427/377

[58] Field of Search ..... 427/294, 335, 350, 377

[56] References Cited

U.S. PATENT DOCUMENTS

| | | | |
|---|---|---|---|
| 3,684,553 | 8/1972 | Van Dyk | 427/335 |
| 4,188,423 | 2/1980 | Swift | 427/335 |
| 4,421,781 | 12/1983 | Reznik | 427/350 |
| 4,923,860 | 5/1990 | Simons | 503/227 |
| 4,957,898 | 9/1990 | Weber | 503/227 |

FOREIGN PATENT DOCUMENTS 2083726A 9/1981 United Kingdom .

*Primary Examiner*—Shrive Beck
*Assistant Examiner*—Katherine A. Bareford
*Attorney, Agent, or Firm*—William W. Holloway; Richard F. Spooner

[57] ABSTRACT

A method of using vaporized solvent to fuse a thermal image includes containment of the solvent vapor.

3 Claims, 1 Drawing Sheet

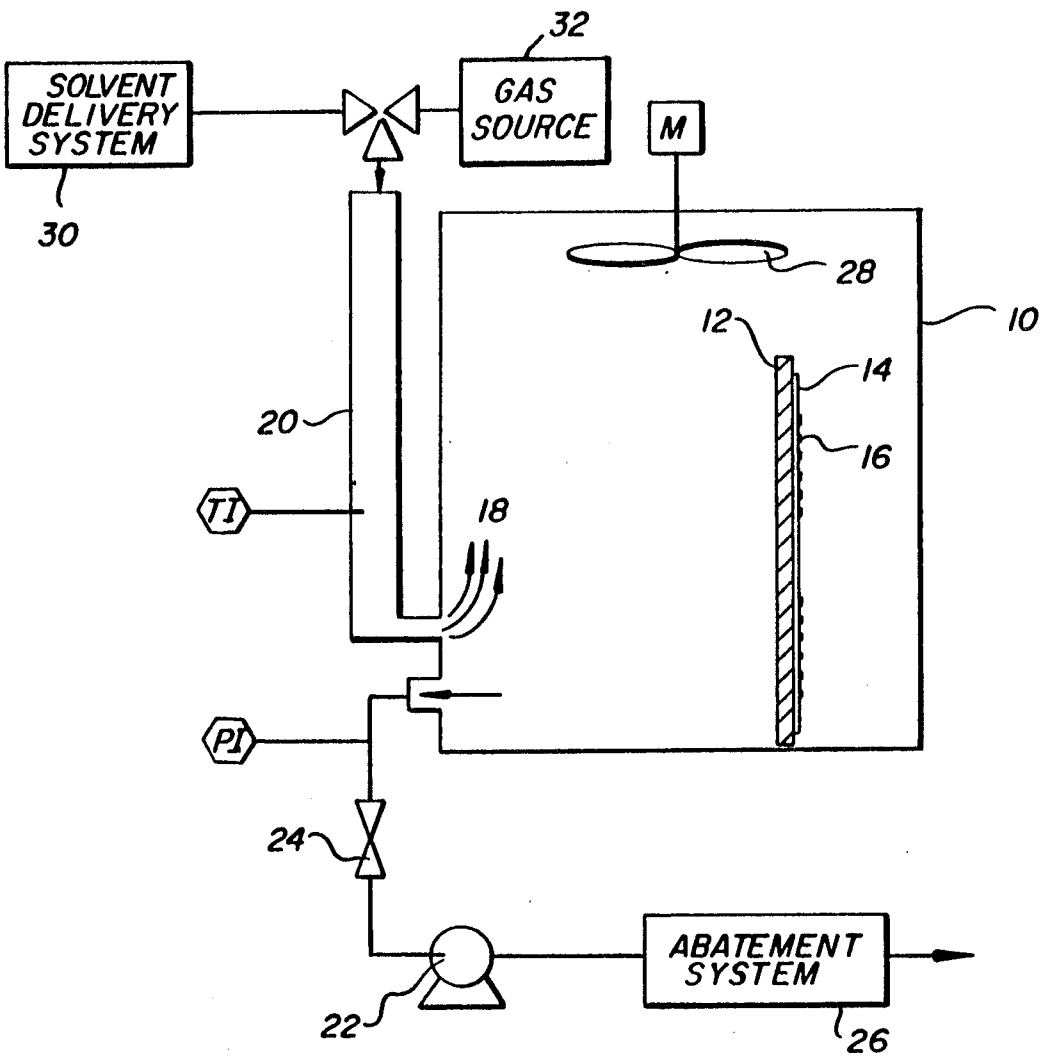
10
28
14
16
12
M
32
GAS SOURCE
18
20
TI
PI
24
22
26
ABATEMENT SYSTEM
SOLVENT DELIVERY SYSTEM
30

SOLVENT FUSING OF THERMAL PRINTER DYE IMAGE

BACKGROUND OF THE INVENTION

1. Field of the Invention

The present invention relates to thermal printers and, more particularly, to fusing dye images in a receiver produced by such thermal printers.

2. Description of the Prior Art

Currently thermal dye transfers are usually followed by a fusing step to further "set" dye into the receiver. The term "thermal dye transfer" refers to all methods of transferring dye by thermal methods irregardless of whether the thermal energy is directly or indirectly generated and/or delivered, such as, but not exclusively resistive head, resistive ribbon, laser and ultrasonic thermal dye transfer. There generally are two technologies which are available for fusing. The first and most common is a thermal fusing process which involves reheating the receiver after thermal dye transfer. Because this technique uses thermal energy and generates a large amount of heat, generally a separate unit isolated from the heat sensitive donor is required to perform this operation. This then requires a distinct two-step process and two separate units, one for image transfer and one for fusing which in turn increases time and costs of thermal imaging. Such heat fusing steps involve the possibility of damage to the receiver in the process of heat treating it to fix or fuse dyes.

Solvent fusing can eliminate the problem of damage to the receiver and also possible damage to the dye caused by subsequent heating steps. In heretofore solvent fusing steps a receiver with a dye image transferred by thermal printing is placed in an enclosure adjacent to an open bath of solvent liquid. The liquid solvent vaporizes and this vapor impregnates the receiver and fuses the dye image into it.

In this method of solvent fusing, the solvent vapor concentration is dictated by the saturated vapor pressure of solvent at the ambient temperature. Sometimes, depending on the solvent being used, sufficient concentration can be reached which causes damage to the dye image. Another problem with this method is that with some solvents it is difficult to reach the appropriate concentration level to cause the solvent to impregnate the receiver to a sufficient extent so as to properly fix the dye image in the receiver. A significant quantity of solvent vapor may escape primarily during placement and removal of the receiver with respect to the enclosure. When the receiver layer is positioned inside the enclosure, the solvent liquid-vapor equilibrium is lost due to loss of vapor. As solvent liquid evaporates to re-establish equilibrium concentration, the liquid is cooled by evaporative cooling which results in a lower vapor concentration than the original, until such time that the liquid has absorbed sufficient heat from the surroundings to again reach ambient temperature. As a result, this natural vapor-liquid equilibrium method of solvent fusing is substantially unregulated or uncontrollable as it is affected by many variable factors including frequency of use, amount of vapor lost during receiver loading/unloading, liquid volume, vapor space volume, and construction material and configuration of enclosure.

Many solvents which are useful for fusing thermally transferred dye images into a receiver layer are toxic and flammable in varying degrees. Problems arising from uncontrolled leakage of solvent vapors may include personnel injury and contamination of adjacent processes as well as emission of solvent to the environment.

SUMMARY OF THE INVENTION

It is an object of this invention to provide an environmentally safe method for solvent fusing of thermal images which efficiently fuses thermally transferred dye images into a receiver without causing damage to such dyes or receiver.

This object is achieved in a method of fusing a thermally printed dye image in a receiver comprising the steps of:

(a) placing the receiver in an enclosure;

(b) reducing the pressure in the enclosure;

(c) producing a vaporized solvent by providing sufficient heat to evaporate liquid solvent flowing through a heat exchanger;

(d) introducing vaporized solvent into the enclosure in sufficient concentration to fuse the dye image in the receiver, but with sufficiently low partial pressure such that the sum of the partial pressure of the solvent added and the initial gas pressure in the enclosure does not equal or exceed atmospheric pressure; and (e) evacuating and purging solvent vapor from the enclosure and recovering or absorbing the solvent prior to opening the enclosure.

Features and advantages of the invention include the following:

1. Solvent fusing eliminates problems of thermal distortion of the dye receiver layer, and also eliminates dye loss through degradation or sublimation of dye which may result from heat fusing methods.

2. Fire hazard risks associated with the use of flammable solvents as the fusing solvent are reduced by reduction of oxygen in mixture with the solvent vapor through partial evacuation or use of inert gas to displace oxygen in the enclosure.

3. A predetermined effective quantity of solvent is introduced into the enclosure containing the dye receiver layer from an external source, thereby providing a controllable fusing method.

4. Solvent vapor concentration can be controlled to below the concentration that would result from solvent vapor and liquid being in equilibrium at ambient temperature in an enclosure, to prevent damage to an image which can occur with some solvents.

5. The use of a batch process in a subatmospheric pressure enclosure which incorporates a sub-atmospheric purge and evacuation to a solvent control system eliminates leakage of potentially hazardous solvent vapors, thereby providing an environmentally safe method for solvent fusing.

BRIEF DESCRIPTION OF THE DRAWINGS

The drawing is a schematic representation of apparatus for performing a method in accordance with the present invention.

DETAILED DESCRIPTION OF THE PREFERRED EMBODIMENT

In accordance with the invention, a predetermined effective amount of liquid solvent is vaporized in a heat exchanger and introduced to the receiver layer in a reduced pressure enclosure to fuse an image into the receiver. Following an appropriate fusing exposure time, the enclosure is evacuated and purged with inert gas while maintained at subatmospheric pressure to provide for recovery, or disposal of all solvent prior to opening the enclosure to the surrounding environment.

As illustrated in FIG. 1, a dye receiver layer 14 is positioned inside an enclosure 10 under atmospheric conditions. The dye receiver layer 14 contains a dye image 16 and is coated on a dye receiver support layer 12. Absolute pressure in the enclosure is reduced to less than atmospheric pressure by means of a vacuum pump 22 and the enclosure is sealed by closure of valve 24. For flammable solvents the enclosure can first be purged with an inert gas such as nitrogen, prior to reducing the enclosure pressure, to displace the oxygen to provide greater protection against fire risks.

A predetermined effective quantity of solvent is introduced to the receiver layer 14 inside enclosure 10, through heat exchanger 20 which completely vaporizes the liquid solvent to solvent vapor 18. An effective quantity of solvent s a quantity which will impregnate the dye and receiver layer at a sufficient rate to fix the dye into the receiver layer in a reasonable processing time, with no significant distortion of the dye image. The dye must be fixed to an extent such that no significant quantity of dye can be removed from the surface of the receiver layer when washed with a solvent capable of dissolving only the dye. The effective quantity of liquid solvent is delivered to the heat exchange 20 by solvent delivery system 30. This delivery system may be one of a number of systems including but not limited to a gas tight syringe, syringe pump or any commercially available precision positive displacement pump capable of reliably pumping into a partial vacuum.

It is important that the heat exchanger provides the heat of vaporization of the solvent used without significantly increasing solvent vapor temperature 18 inside enclosure 10. An excessive rise in solvent vapor temperature and/or receiver layer 14 temperature will result in inefficient fusing of the dye image 16 into the receiver layer 14. Complete and uniform gas-vapor mixing is provided by fan 28 to ensure efficient exposure of the solvent vapor to the dye receiver layer, especially when the apparatus is used for fusing of multiple receiver layers in close proximity to one another. Other systems such as external gas recirculation blowers can also be utilized for this application. Both solvent vapor concentration and exposure time of the dye receiver layer to the solvent vapor are important for achieving effective fusing of the dye into the receiver layer. Effective fusing is characterized by complete fixing of the dye into the receiver layer with no significant distortion of the dye image. Since the rate at which a dye receiver and a dye are dissolved varies between different solvents, the vapor concentration and exposure time required for effective fusing also varies from solvent to solvent. Aggressive solvents which quickly solubilize a receiver and dye may cause distortion of the dye images at the concentration reacted at equilibrium ambient temperature in an enclosure in less time than is practical for application. The present invention provides a controllable means of exposing a dye receiver layer to a solvent vapor concentration below that obtained by allowing liquid solvent to equilibrate in an enclosure at ambient temperature. Effective fusing of a dye image into a receiver layer has been attained with an exposure time of 2 to 10 minutes and solvent concentrations of 0.9 to 1.6 grams solvent/liter of enclosure volume with the temperature range of 20° to 35° C. The preferred solvent is $CH_2Cl_2$ introduced at a concentration of 1.3 grams/liter in an enclosure with an initial absolute pressure of 60 mm Hg and temperature of 22° C.

The critical parameter of concentration is in terms of grams or moles of solvent per unit enclosed volume. Increasing the relative percent of solvent in the enclosure by reducing the quantity of air or inert gas inside the enclosure is ineffective for enhancing the fusing. The concentration of solvent used for fusing must be less than the saturated concentration for a particular solvent at the maintained process temperature to avoid condensing solvent on the dye receiver layer and damaging the image. When this condition is maintained, the partial pressure of the solvent vapor added to the enclosure is lower than the saturated vapor pressure at the process temperature, and the partial pressure of the vapor inside the enclosure increases proportionally with an increase in quantity of solvent introduced to the enclosure. The total pressure in the enclosure, following addition of the solvent, is equal to the sum of the pressure of the air remaining in the enclosure following partial evacuation and the pressure of the solvent added at the process temperature in accordance with Dalton's law of summation of partial pressures. It is important that the initial pressure inside the enclosure is reduced adequately to provide for the contribution of partial pressure of added solvent vapor, so as not to exceed the atmospheric pressure resulting in a net positive pressure inside the enclosure, and a release of solvent vapor to the environment surrounding the enclosure. Following the completion of exposure of receiver layer to solvent vapor, the enclosure 10 is simultaneously evacuated and purged with inert gas from gas source 32 at an absolute enclosure pressure below atmospheric pressure for a time sufficient to remove all solvent vapor from the enclosure. This time is dependent on the enclosure volume and gas flow rates. The exhaust stream is treated by a solvent recovery and/or abatement system 26 to prevent escape to the environment.

Any sublimable dye can be used provided it has been transferred to the dye image receiving layer by the action of heat. Example of sublimable dyes include anthraquinone dyes, e.g., Sumikalon Violet RS® (product of Sumitomo Chemical Co., Ltd.), Dianix Fast Violet 3R FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical, Co. Ltd.); and Mikatazol Black 5GH® (product of Mitsui Toatsu Chemicals, Inc.); direct dyes such as Direct Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd. and Aizen Malachite Green® (product of Hodogays Chemical Co., Ltd.); or any of the dyes disclosed in U.S. Pat. No. 4,541,830, the disclosure of which is hereby incorporated by reference.

The dye receiver layer 14 can be a commercially available polycarbonate or polyester which is capable of having a dye thermal transferred and fused into it and can be coated on a dye support layer 16 such as paper.

EXAMPLE

In an example according to this invention, unfused red, green and blue images were formed in a polycarbonate receiver by thermal transfer. These images were then exposed to 21 grams of solvent vapor in a 16.4 liter enclosure at an absolute total pressure of 350 mm Hg for 5 minutes. The solvent vapor was evacuated from the enclosure and the enclosure pressure equilibrated to atmospheric pressure prior to dye receiver removal from the enclosure. The fused images were washed with methanol and were unaffected. Similar washing of unfused images resulted in complete dye removal.

The solvent used was $CH_2Cl_2$. The dye receiver layer was placed in the enclosure under atmospheric pressure. The enclosure with a VWR Scientific vacuum oven, model 1410 which was modified for solvent introduction through a heat exchanger. Temperature was maintained at 22° C. The enclosure pressure was reduced to 60 mm Hg using a Gast vacuum pump model 0522-V50-G18DX. Twenty-one grams of $CH_2Cl_2$ was introduced from a gas tight syringe through a heat exchanger comprised of a packed column wrapped with heat tape and controlled by a Variac voltage regulator. Solvent entered the enclosure as a vapor over a 15 second interval. Total absolute pressure inside the enclosure increased to 350 mm Hg, reflecting the contribution of the partial pressure of the $CH_2Cl_2$ vapor, and enclosure vapor temperature remained constant at 22° C. Following a 5 minute exposure time, the enclosure was simultaneously purged with nitrogen and evacuated at an absolute pressure below atmospheric pressure for 5 minutes before purging the enclosure to atmospheric pressure and removing the receiver layer. Measurements taken at the open door of the enclosure following this procedure with a Drager Rochrchen detector indicated solvent concentration was below the test equipment's lower detectable limit of 100 ppm. An improvement can be realized by treating the solvent vapor evacuated from the enclosure by any of the well known methods of solvent vapor recovery or abatement such as condensation and collection, or adsorption onto activated carbon.

The invention has been described in detail with particular reference to certain preferred embodiments thereof, but it will be understood that variations and modifications can be effected within the spirit and scope of the invention.

We claim:

1. An environmentally safe method of fusing a thermal printing dye image into a receiver, comprising the steps of:

(a) placing the receiver containing a dye image into an enclosure;

(b) reducing the absolute pressure in the enclosure to below atmospheric pressure;

(c) introducing a predetermined effective quantity of vaporized solvent concentration, such that the sum of the partial pressure of the added solvent vapor and the initial gas pressure in the enclosure does not equal or exceed atmospheric pressure, to fuse the dye image into the receiver with no significant distortion of the dye image; and (d) evacuating solvent vapor from the enclosure.

2. The invention as set forth in claim 1, wherein the temperature of the vaporized solvent and the receiver layer is maintained below 25° C.

3. The invention as set forth in claim 1, wherein the initial pressure in the enclosure is reduced to 60 mm Hg, the solvent is $CH_2Cl_2$ and the solvent concentration is selected from the range 0.9 to 1.6 grams solvent/liter enclosure volume.

* * * * *

UNITED STATES PATENT AND TRADEMARK OFFICE

CERTIFICATE OF CORRECTION

PATENT NO. : 5,143,754

DATED : September 1, 1992

INVENTOR(S) : Michael E. Long, David L. VanGalio and Helmut Weber

It is certified that error appears in the above-identified patent and that said Letters Patent is hereby corrected as shown below:

Title Page, Column 2 (Attorney, Agent, or Firm)...
Delete "Richard F. Spooner" as an attorney and insert --Raymond L. Owens--.

Signed and Sealed this

Seventh Day of September, 1993

Bruce Lehman

*Attest:*

BRUCE LEHMAN

*Attesting Officer*

*Commissioner of Patents and Trademarks*